US010213658B1

(12) United States Patent
Smith, Jr.

(10) Patent No.: US 10,213,658 B1
(45) Date of Patent: Feb. 26, 2019

(54) RACKET CROSS-STRING WEAVING ASSISTANT

(71) Applicant: Judson Allen Smith, Jr., Boulder, CO (US)

(72) Inventor: Judson Allen Smith, Jr., Boulder, CO (US)

( * ) Notice: Subject to any disclaimer, the term of this patent is extended or adjusted under 35 U.S.C. 154(b) by 0 days.

(21) Appl. No.: 15/830,483

(22) Filed: Dec. 4, 2017

(51) Int. Cl.
*A63B 51/00* (2015.01)
*A63B 51/16* (2006.01)
*A63B 51/015* (2015.01)
*A63B 51/14* (2006.01)

(52) U.S. Cl.
CPC ..... *A63B 51/16* (2015.10); *A63B 51/015* (2015.10); *A63B 2051/004* (2013.01); *A63B 2051/143* (2013.01); *A63B 2051/146* (2013.01)

(58) Field of Classification Search
CPC ..... A63B 51/00; A63B 51/015; A63B 51/14; A63B 51/16; A63B 2051/004; A63B 2051/143; A63B 2051/146
See application file for complete search history.

(56) References Cited

U.S. PATENT DOCUMENTS

| | | | | | |
|---|---|---|---|---|---|
| 2,156,092 | A * | 4/1939 | Johnson | A63B 51/16 | 139/33 |
| 3,994,496 | A * | 11/1976 | Burchett | A63B 51/14 | 473/557 |
| 4,082,272 | A * | 4/1978 | Garver | A63B 51/14 | 473/557 |
| 4,270,752 | A * | 6/1981 | Strelow | A63B 51/14 | 473/557 |
| 4,339,131 | A * | 7/1982 | Balaban | A63B 51/14 | 473/557 |
| 4,452,452 | A * | 6/1984 | Timmer | A63B 51/14 | 473/557 |
| 7,862,455 | B1 * | 1/2011 | Ratmiroff | A63B 51/00 | 473/553 |

FOREIGN PATENT DOCUMENTS

| | | | | |
|---|---|---|---|---|
| WO | WO 2013/127375 | * | 9/2013 | A63B 53/14 |

* cited by examiner

*Primary Examiner* — Raleigh W Chiu

(57) ABSTRACT

A set of racket cross-string guides which are pre-woven over a string guide holder in the same pattern used for inserting the racket cross-strings.

6 Claims, 11 Drawing Sheets

101
102
103
104
100

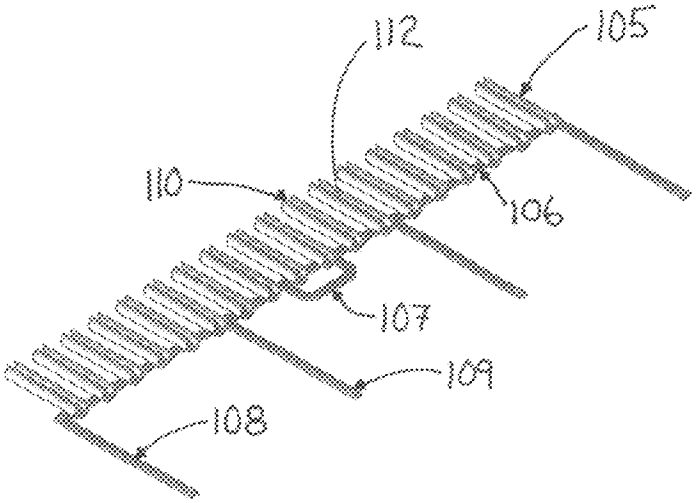
FIG. 2D ISOMETRIC VIEW
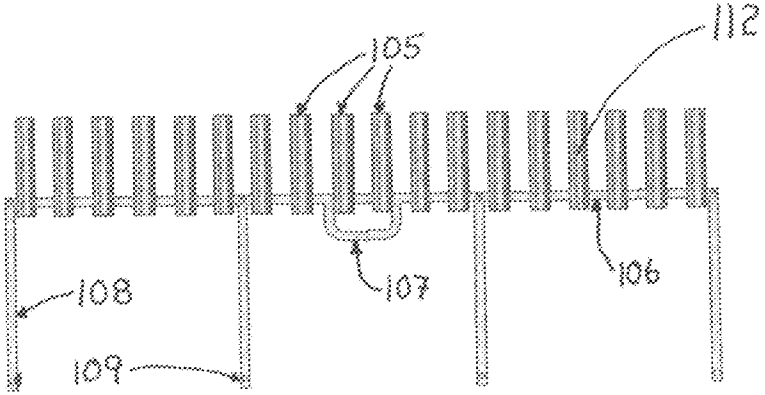
FIG. 2A TOP VIEW
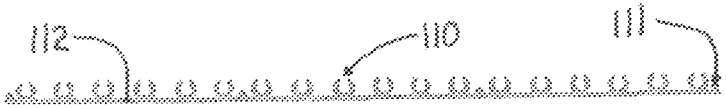
FIG. 2B FRONT VIEW
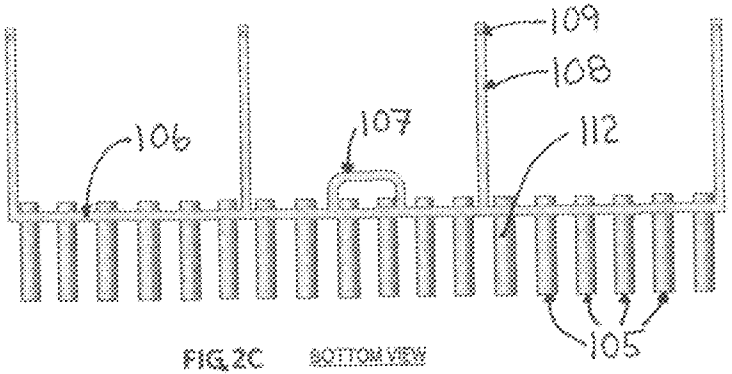
FIG. 2C BOTTOM VIEW

RACKET CROSS-STRING WEAVING ASSISTANT

FIELD OF THE INVENTION

The invention relates to the field of game rackets used for sports employing a ball or the like, for example tennis, squash, racquetball or badminton rackets and more specifically to a product that assists with the weaving of the cross-strings during the racket stringing operation.

The invention relates more particularly to rackets in which the string pattern carried by the frame comprises a grid parallel to the longitudinal axis of the handle. The string pattern is composed of vertical strings, often called 'main' strings, and a grid of strings perpendicular to the former, often called 'cross-strings'. These vertical strings and cross-strings are interlaced with the cross-strings passing alternately above and then below the elements of the 'main strings' grid in a weave pattern.

The production of the string pattern is typically a manual operation with the assistance of a stringing machine and is carried out according to well-known techniques.

BACKGROUND OF THE INVENTION

Rackets such as tennis, racquetball, squash, etc. are typically strung by hand using a stringing machine. The stringing machine assists in holding the racket frame, holding the string in place as it is positioned in the racket and applying the desired tension to the string. The invention relates to the stringing of racket frames and particularly to a product that assists with lacing/weaving of the cross-strings in such a frame. In the process of stringing rackets such as tennis rackets or squash rackets, it is the usual practice to clamp the racket frame onto a support which is rotatable on a vertical shaft and to first string the frame with the main strings which are parallel to the longitudinal axis of the handle. Once the main strings are properly tensioned and secured, the next step is to weave the cross-strings through the main strings. For lacing a cross-string, the string is inserted through a string hole located in the racket frame and is passed alternately under one main string and over the adjacent main string in the manner of a flat weave, whereupon the string is passed through the opposite string hole of the frame and is properly tensioned and temporarily secured by a string clamp. The next cross-string must be passed alternately under one main string and over the adjacent main string in the opposite manner as the previous cross-string in order for the string bed weave to be correct. Lacing the cross-strings by hand is a time-consuming operation which demands considerable time and manual dexterity and is often done erroneously. The two most common errors that occur during weaving the cross-strings are 1) a cross-string is pulled over or under more than 1 main string causing the string bed to be woven incorrectly or 2) a cross-string is woven in the exact same pattern as the previous cross-string causing the string bed to be woven incorrectly.

To facilitate the lacing of the cross-strings, there are four relevant apparatuses.

1) The first apparatus (U.S. Pat. No. 3,994,496—sports racket stringing aid) is a portable device for installing transverse strings in a sports racket having previously installed longitudinal (main) strings. One end can be hooked under existing strings for support while the bottom is held against alternate longitudinal (main) strings by pressure against a handle at the other end. Sliding of a member with undercut nitches holds the other alternate longitudinal (main) strings, to maintain transverse clearance for threading new cross-strings into place. This apparatus has the disadvantage that the hand-held apparatus applies pressure to the main strings in a way that can both damage the string surface as well as stretch the string causing a change in the string tension. Another disadvantage is that it is possible to improperly position the apparatus such that two consecutive cross-strings are placed in the exact same string alignment with respect to the main strings instead of alternating over and under the main strings.
2) The second apparatus (U.S. Pat. No. 4,452,452) is similar to the first. The apparatus of the invention comprises a first beam containing two rows of vertical slots with the slots of one row alternating with the slots of the other row to form pairs of slots, each comprising one slot from each row, the upper surface of said beam forming upper string support surfaces between these pairs of slots. The slots of each row have a spacing at least approximately corresponding to twice the average pitch of the main strings of the racket frame. The apparatus further comprises a second gripper beam adapted to be situated above said first beam, said second gripper beam vertically movable with respect to said first beam between open and closed positions, said second gripper beam having a plurality of downwardly facing string gripping surfaces, one associated with each slot of said first beam and, like said slots, arranged in pairs, the gripping surfaces of at least the majority of the gripping surface pairs being separated by a downwardly extending lug. By the provision of the two staggered rows of slots in the lower first beam and the corresponding gripping surfaces on the upper second gripper beam, it is now possible after lacing-in a cross-string to quickly change the channel between alternate main strings by shifting the apparatus in a lateral direction with respect to the main strings so as to move these strings from a first position in alignment with the slots of one row to a second position in alignment with the slots of the other row without the necessity of removing the apparatus from the cross-strings. This apparatus has the disadvantage that it is time consuming to use for the cross-stringing process. This apparatus also is a fixed length which does not easily accommodate rackets with different numbers of main strings (many tennis rackets have either 16 or 18 main strings). This known apparatus has the further disadvantage that when displacing the main strings to allow passage of the cross-strings this action is likely stretching the main strings which ultimately reduces the string tension.
3) The third apparatus (U.S. Pat. No. 7,862,455—Stringing Sandwich) is one that lays strings on top of each other within a frame; the overlying of the strings, once the process is finished, will create the arrays of intersections between the vertical and horizontal strings that create the net in a racket, such as a tennis racket, or squash racket. The apparatus has of a main section, a complementary overlap cover for the main section, a way of securing and undoing the main section to and from the frame of the racket, and an inlet and outlet passage for the strings to and from the main section. In addition, a preferred embodiment includes the main section with vertical and horizontal routes that overpass each other made of transparent plastic, and consisting of any number of vertical and horizontal routes. One disadvantage of the stringing sandwich is that sometimes the main section may not be a perfect fit to the design of the racket, since the design of the racket may not allow for that perfect fit, the fit between the geometric routes and the holes or openings on the frame of the racket. In other words, a perfect fit may not be 100% possible since some intersections are so close to the frame of the racket that the apparatus may need of the help the operator. The operator may be forced to input those intersections by hand, one by one, in those tight spots difficult to reach by the apparatus or Stringing Sandwich. Another significant disadvantage of the stringing sandwich is that when the apparatus is in place it prevents the tennis strings from being tensioned and held by a clamp until all strings are in place and the apparatus is removed. The typical method for stringing a racket is to tension and clamp each main string or cross-string as it is inserted through the racket frame.

4) The fourth apparatus (https://www.youtube.com/watch?v=6Tuc5ISysro) is in the public domain and is a length of twine tied in to connected loops and manually woven through the racket's main strings after they are in place. The twine is used to weave cross-strings by pulling the tennis string through the main strings. The primary disadvantage of this apparatus is that it can only be used to weave the cross-strings in one direction and then the operator has to manually weave the cross-strings in the opposite direction. Needing to alternate between two different insertion techniques for the cross-strings is both confusing and error-prone.

SUMMARY OF THE INVENTION

The primary objectives of the invention are to provide an apparatus that allows for quick, easy and error-free placement of the cross-strings in a sports racket. The apparatus in this invention also allows the cross-stringing procedure to be easily incorporated into the existing stringing techniques used by both amateur and professional racket stringing persons.

The invention is composed of a set of string guides which are pre-woven over a string guide holder. The string guide holder is placed horizontally across the face of the sports racket prior to stringing. When the main strings are being placed into the racket, each of the main strings pass through the corresponding passage way in the string guide holder. Once all of the main strings are set into place in the racket and tension is applied and the strings are clamped in place, then the string guides are slid off of the string guide holder onto the racket main strings. The ends of the string guides are placed over the top edge of the racket frame for easy accessibility. At this point the string guide holder is easily removed from the main racket strings utilizing the pre-cut slots in the string guide holder. With the string guides in place, the person stringing the racket inserts the first cross string through the racket frame and pulls about 10 inches of string through the frame. The person then selects the first string guide, which is the string guide closest to the end of the racket where the cross-stringing is being started, and puts about 6 inches of string through the loop in the end of the string guide and then uses the string guide to pull the string through the main strings toward the other side of the racket. Once the racket string is pulled through the main strings it is removed from the string guide, the string guide is discarded, and the racket string is put through the correct hole in the racket frame, tension is applied, and the string clamp is put into place. This process is then repeated until all cross-strings are pulled through the main strings using the string guides to assist in the weaving process.

Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents and alternative constructions that fall within the spirit and scope of the invention as expressed in the claims.

Aspects of the present invention provide cross-string guides and a string guide holder. One embodiment of the cross-string guides is made from braided hollow-core dacron line with a loop on each end. The loop on each end of the braided dacron line is created by feeding the end of the dacron line back into the center of the dacron line forming a loop whereby the line end is held fast inside the dacron line due to the pressure exerted by the outer dacron line when the loop end is pulled. The loop on each end can be formed and held together with an adhesive substance such as glue or epoxy. The loop on each end could also be held together with a tied knot or with a small fixture which is crimped, or heat sealed.

Another embodiment of the cross-string guides is made from other material compositions such as nylon, hemp, linen, cotton, Polytetrafluorethylene string (the same material used in Gore-Tex fabric and some types of dental floss), polypropylene, acrylic, polyester string, etc. with a loop on each end. The loop on each end can be formed and held together with an adhesive substance such as glue or epoxy. The loop on each end could also be held together with a tied knot or with a small fixture which is crimped, or heat sealed.

One embodiment of the string guide holder is made from plastic. The plastic string guide holder can be created using any number of manufacturing techniques including injection molding, thermoforming and 3D printing.

Another embodiment of the string guide holder is made from a single 8½×11 inch sheet of heavy card stock paper. The string guide is stamped out of the card stock paper and folded such that it forms a series of paper spindles through which the cross-string guides are woven.

Another embodiment of the string guide holder is made from paper or plastic tubes held together by a piece of card stock or plastic.

These and other embodiments are described in further detail herein.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings, wherein:

FIG. 2A is a top view of a one-piece solid construction string guide holder in accordance with an illustrative embodiment of the invention.

FIG. 2B is a front view of a one-piece solid construction string guide holder in accordance with an illustrative embodiment of the invention.

FIG. 2C is a bottom view of a one-piece solid construction string guide holder in accordance with an illustrative embodiment of the invention.

FIG. 2D is an isometric view of a one-piece solid construction string guide holder in accordance with an illustrative embodiment of the invention.

LIST OF REFERENCE NUMBERS ON FIGURES

Figures 1A, 1B, 1C, 1D:
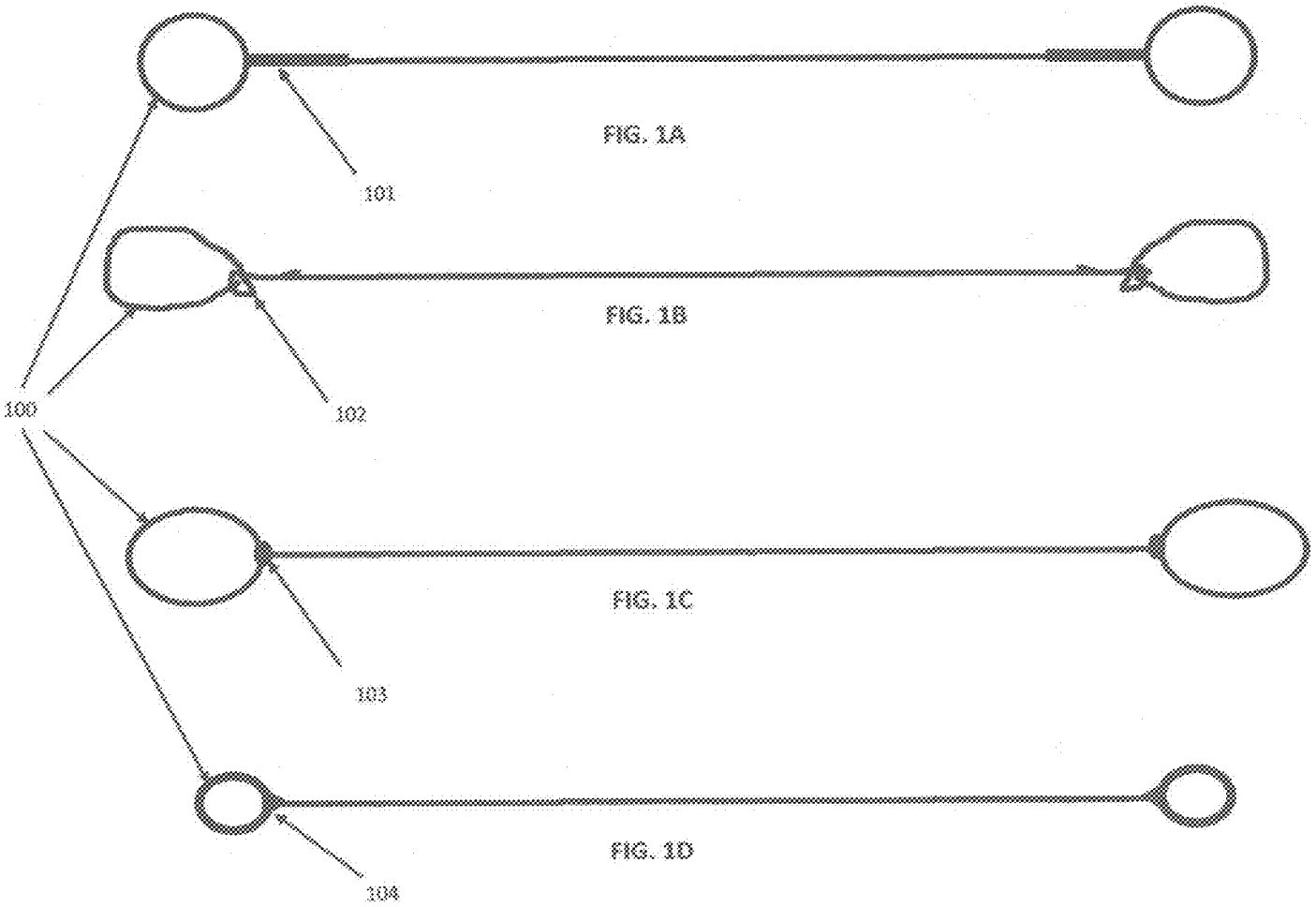
FIG. 1A is a top view of a cross-string guide with a loop where the string end is pulled back inside the hollow-core dacron in accordance with an illustrative embodiment of the invention.
FIG. 1B is a top view of a cross-string guide with a knot tied in it to create a loop in accordance with an illustrative embodiment of the invention.
FIG. 1C is a top view of a cross-string guide where a glue joint is used to create a loop in accordance with an illustrative embodiment of the invention.
FIG. 1D is a top view of a cross-string guide where a piece of material is crimped or heat sealed to create a loop in accordance with an illustrative embodiment of the invention.

100. Cross-string guide
101. Loop with hollow core dacron loop connection
102. Loop with knot
103. Loop with glue joint
104. Loop created with crimp or heat seal
105. Hollow longitudinal guides
106. Connecting bar
107. Centrally placed handle
108. Tie-down straps
109. Tie-down hole
110. String guide hollow longitudinal guide opening
111. Tie-down strap connecting nub
112. String guide holder
113. Support fin
114. Folding tab
115. Folding tab slot
116. Spindle
117. Spindle end holes
118. Spindle side flaps
119. Guide removal slit
120. Spindle slots
121. Unstrung racket frame
122. Racket main strings
123. Roll of racket string
124. Racket frame grommet hole

DETAILED DESCRIPTION

Referring now to the drawings, where like or similar elements are designated with identical reference numerals throughout the several views where appropriate. FIG. 1A shows one embodiment of the cross-string guide.

FIG. 1A shows one embodiment of a cross-string guide. This embodiment comprises the cross-string guide 100 with a loop 101 where the string end is pulled back inside the hollow-core dacron.

FIG. 1B shows a second embodiment of a cross-string guide. This embodiment comprises the cross-string guide 100 with a knot tied in it to create a loop 102.

FIG. 1C shows a third embodiment of a cross-string guide. This embodiment comprises the cross-string guide 100 where a glue joint is used to create a loop 103.

FIG. 1D shows a fourth embodiment of a cross-string guide. This embodiment comprises the cross-string guide 100 where a piece of material is crimped, or heat sealed to create a loop 104.

FIG. 2A shows a top view embodiment of a one-piece solid construction string guide holder 112. This embodiment comprises a number of parallel, equally spaced, hollow longitudinal guides 105 which are joined together at one end with a connecting bar 106 that is perpendicular to the hollow longitudinal guides. Connecting bar 106 also has attached a centrally placed handle 107 and a number of tie-down straps 108 each of which has a tie-down hole 109 on the end opposite the connecting bar 106.

FIG. 2B shows a front view embodiment of a one-piece solid construction string guide holder 112. This embodiment view shows the string guide hollow longitudinal guide opening 110 along the top of each hollow longitudinal guide. This embodiment view also shows the tie-down strap connecting nubs 111 located on the connecting bar 106 at the juncture of each tie-down strap 108.

FIG. 2C shows a bottom view embodiment of a one-piece solid construction string guide holder 112. This embodiment view comprises a number of parallel, equally spaced, hollow longitudinal guides 105 which are joined together at one end with a connecting bar 106 that is perpendicular to the hollow longitudinal guides. Connecting bar 106 also has attached a centrally placed handle 107 and a number of tie-down straps 108 each of which has a tie-down hole 109 on the end opposite the connecting bar 106.

FIG. 2D shows an isometric view embodiment of a one-piece solid construction string guide holder 112. This embodiment view comprises a number of parallel, equally spaced, hollow longitudinal guides 105 with a string guide hollow longitudinal guide opening 110. The hollow longitudinal guides 105 are joined together at one end with a connecting bar 106 that is perpendicular to the hollow longitudinal guides. Connecting bar 106 also has attached a centrally placed handle 107 and a number of tie-down straps 108 each of which has a tie-down hole 109 on the end opposite the connecting bar 106.

Figure 3A:
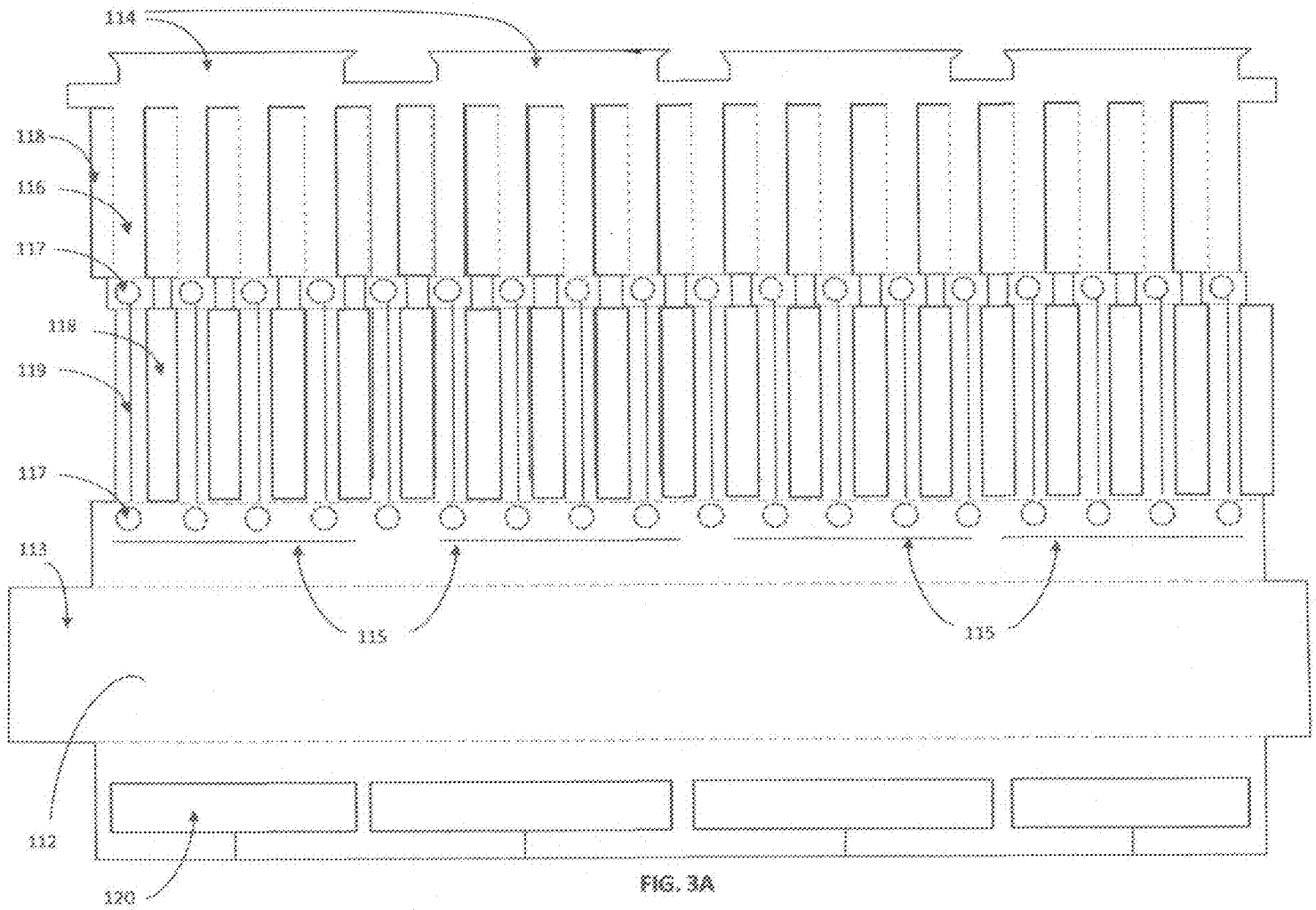
FIG. 3A is a top view of a heavy card stock string guide holder template in accordance with an illustrative embodiment of the invention.

FIG. 3A shows one embodiment of the cross-string guide holder which can be stamped or cut and then folded to hold the cross-string guides. This embodiment comprises the string guide holder 112 with support fin 113 which holds the string guide holder on top of the racket. Folding tabs 114 are inserted into folding tab slots 115 which causes formation of spindle 116. Spindle 116 is composed of spindle end holes 117 and spindle side flaps 118 as well as a guide removal slit 119 which is instrumental in removal of the string guide holder during the stringing process. Spindle slots 120 are used for holding one end of the spindles after cross-string guides are placed upon the string guide holder.

Figure 3B:
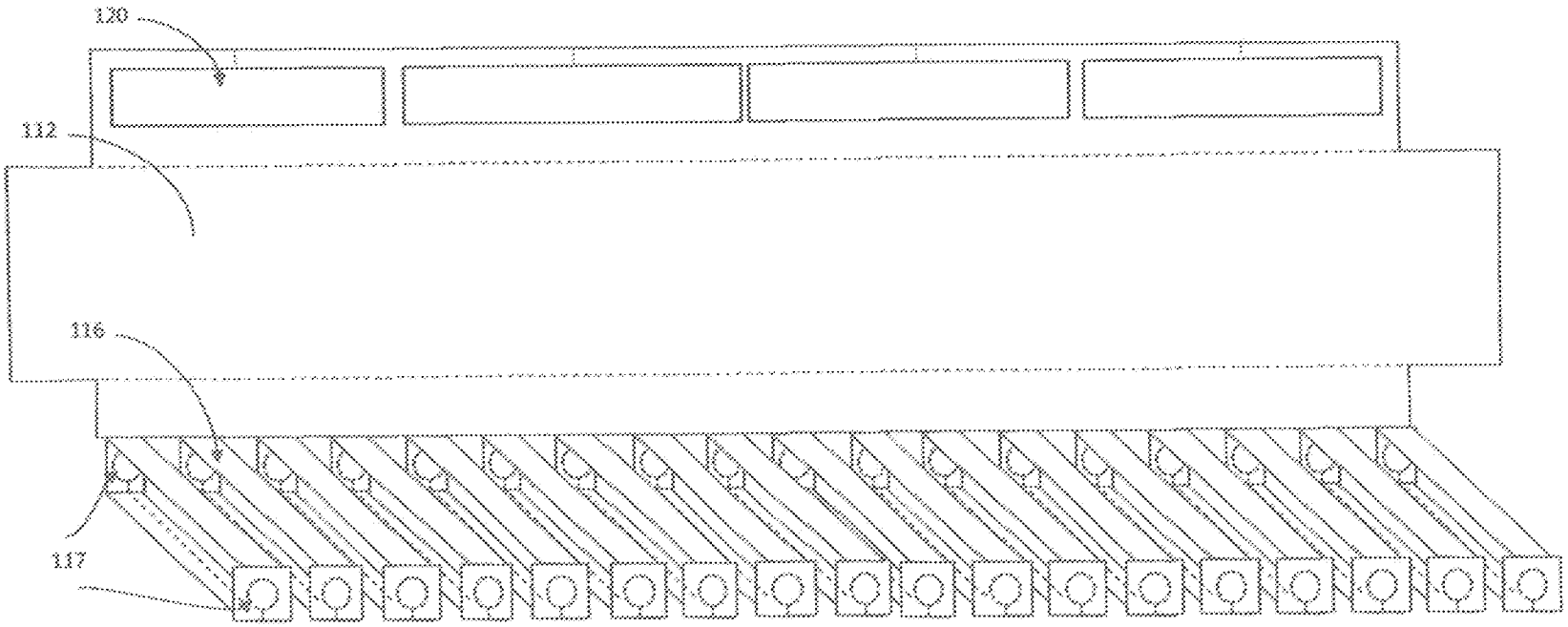
FIG. 3B is a front view of a partially-folded string guide holder which is ready to have string guides loaded onto it in accordance with an illustrative embodiment of the invention.

FIG. 3B shows a partially folded string guide holder 112 with spindles 116 protruding and ready to accept the string guides.

Figure 3C:
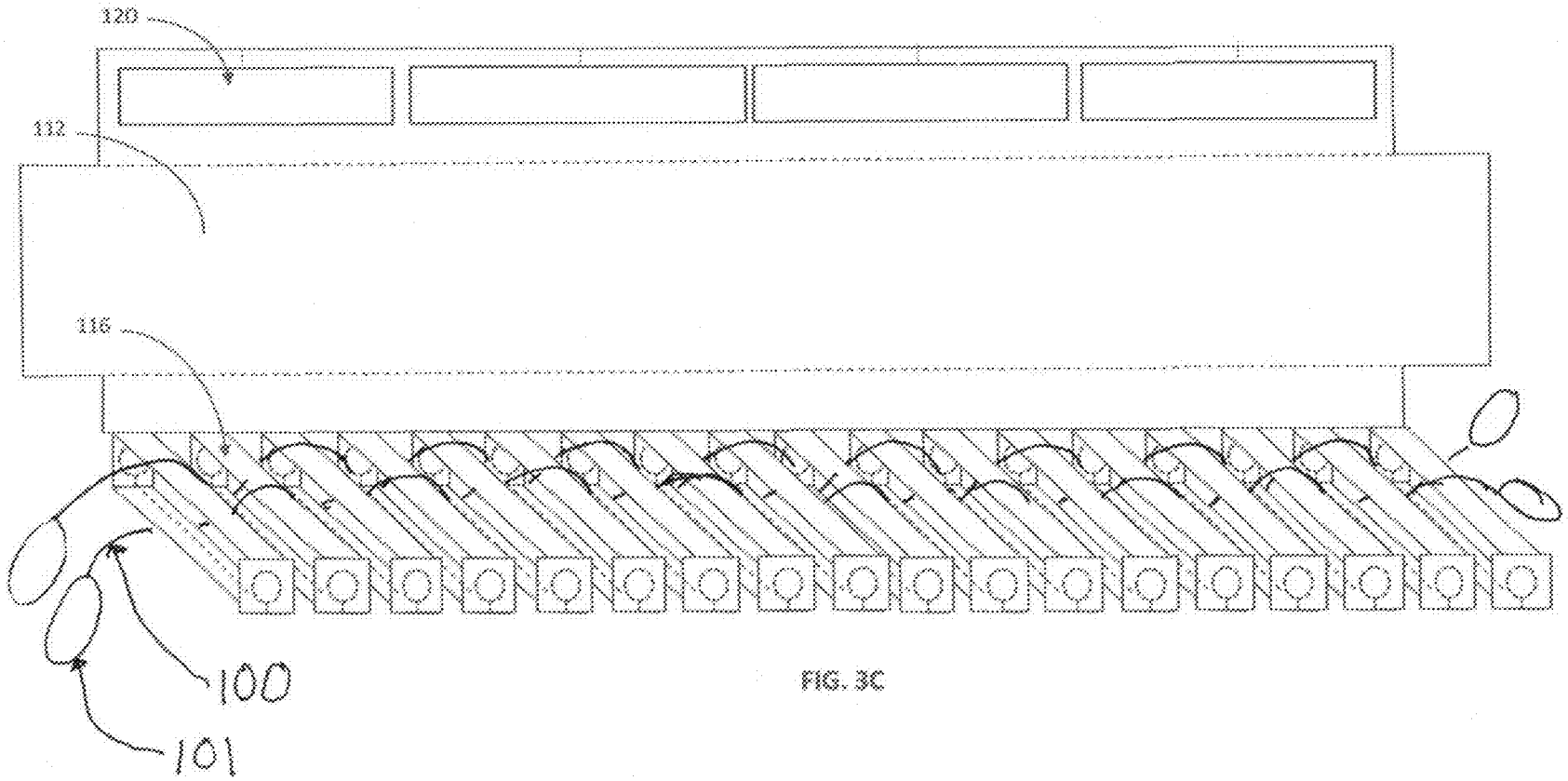
FIG. 3C is a front view of a partially-folded string guide holder which has 2 string guides loaded onto it in accordance with an illustrative embodiment of the invention.

FIG. 3C shows a partially folded string guide holder 112 with spindles 116 protruding and with two cross-string guides 100 woven on the spindles 116 in the alternating pattern used for racket cross-strings.

Figure 3D:
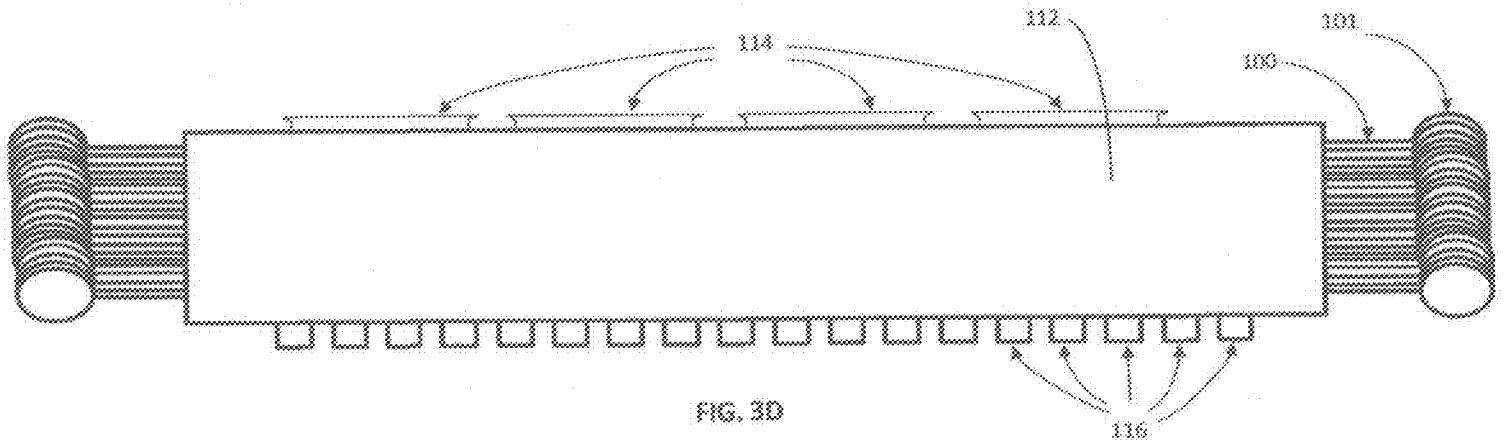
FIG. 3D is a top view of a fully-folded string guide holder which has 20 string guides loaded onto it in accordance with an illustrative embodiment of the invention.

FIG. 3D is a top view of the completely assembled string guide holder 112 with cross-string guides 100 woven on the spindles 116.

Figure 3E:
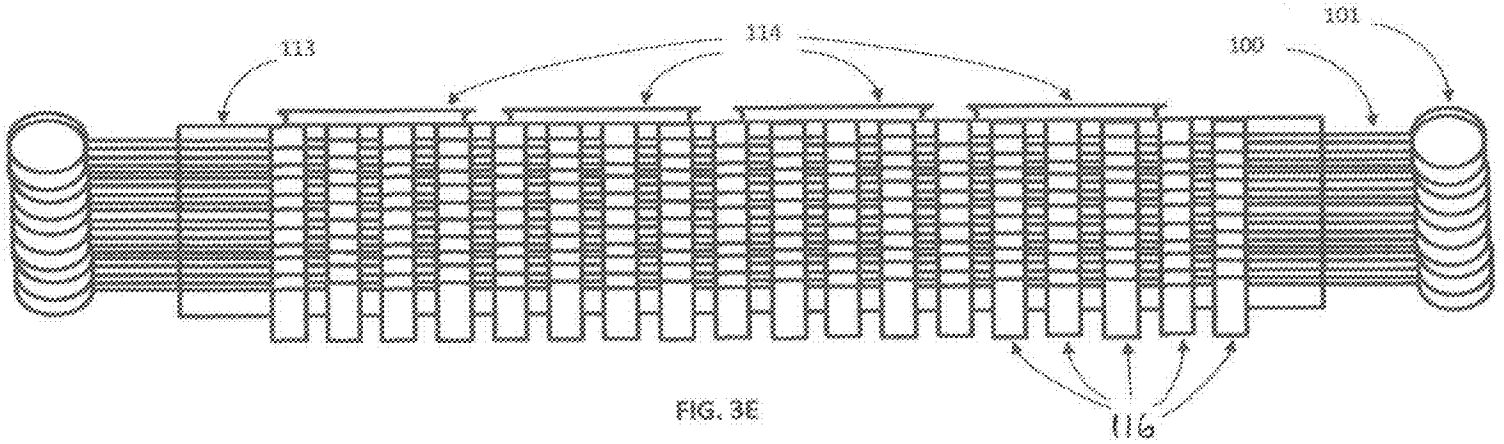
FIG. 3E is a bottom view of a fully-folded string guide holder which has 20 string guides loaded onto it in accordance with an illustrative embodiment of the invention.

FIG. 3E is a bottom view of the completely assembled string guide holder 112 with cross-string guides 100 woven on the spindles 116.

Figure 4A:
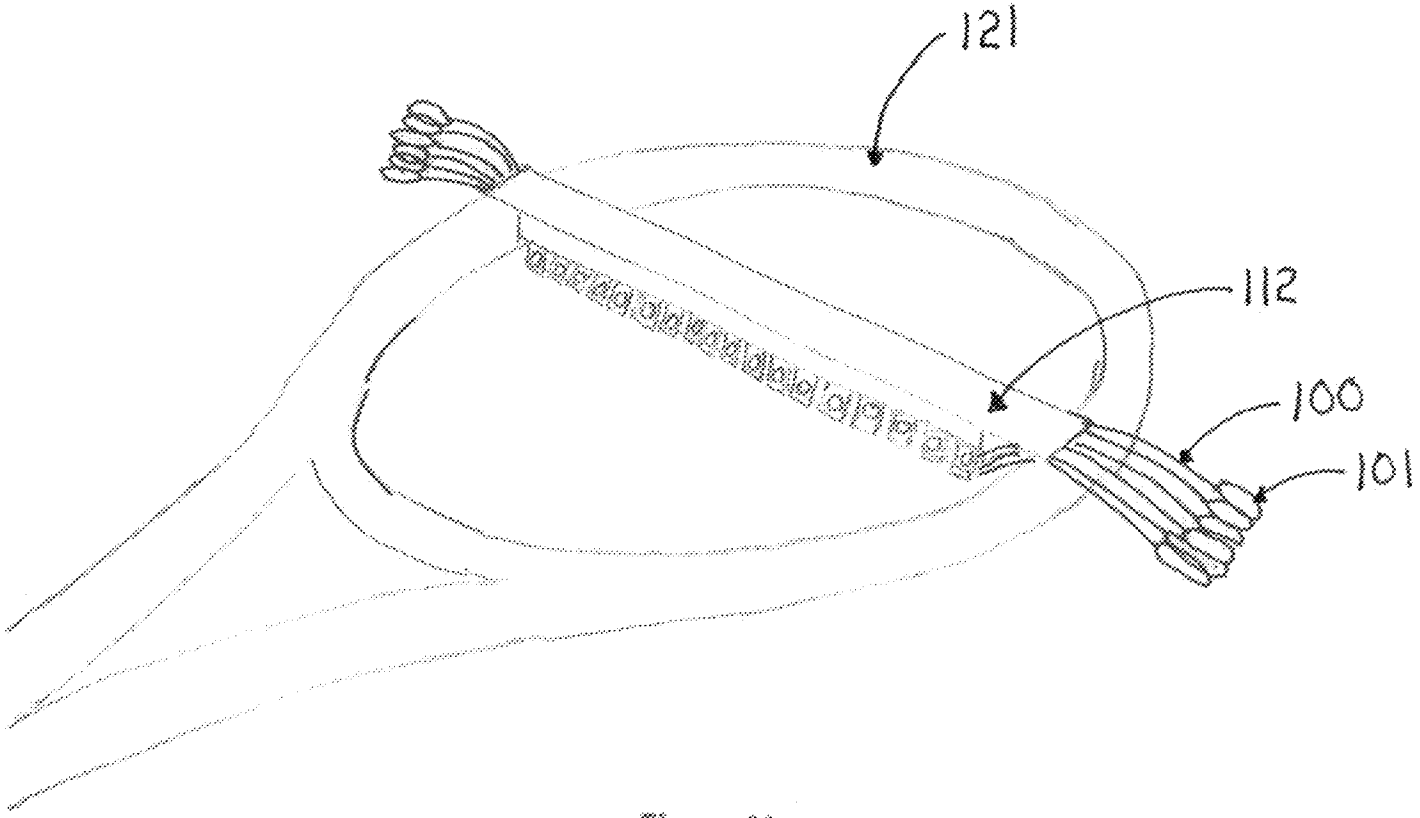
FIG. 4A is a top view of a fully-folded string guide holder, with cross-string guides, placed across an unstrung racket in accordance with an illustrative embodiment of the invention.

FIG. 4A is an oblique view illustrating the placement of a string guide holder 112 on top of an unstrung racket frame 121 comprising cross-string guides 100 each terminating in a loop with hollow core dacron loop connection 101.

Figure 4B:
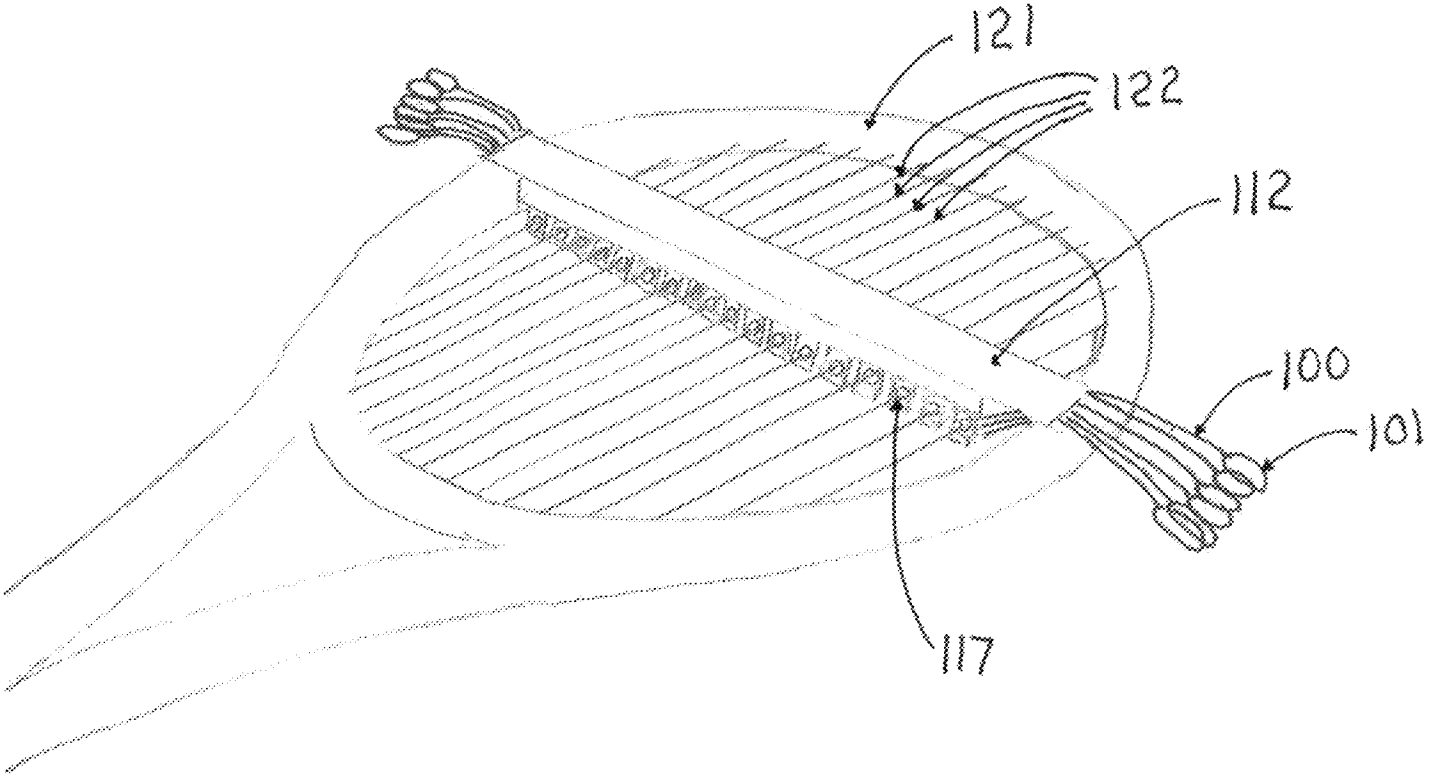
FIG. 4B is a top view of a string guide holder, with cross-string guides, placed across a racket with the main strings in place in the racket frame and extending through the string guide holder in accordance with an illustrative embodiment of the invention.

FIG. 4B is an oblique view illustrating the placement of a string guide holder 100 on top of a racket frame 121 which has the racket main strings 122 inserted through the spindle holes 117 in the string guide holder 112 and which has cross-string guides 100 each terminating in a loop with hollow core dacron loop connection 101.

Figure 4C:
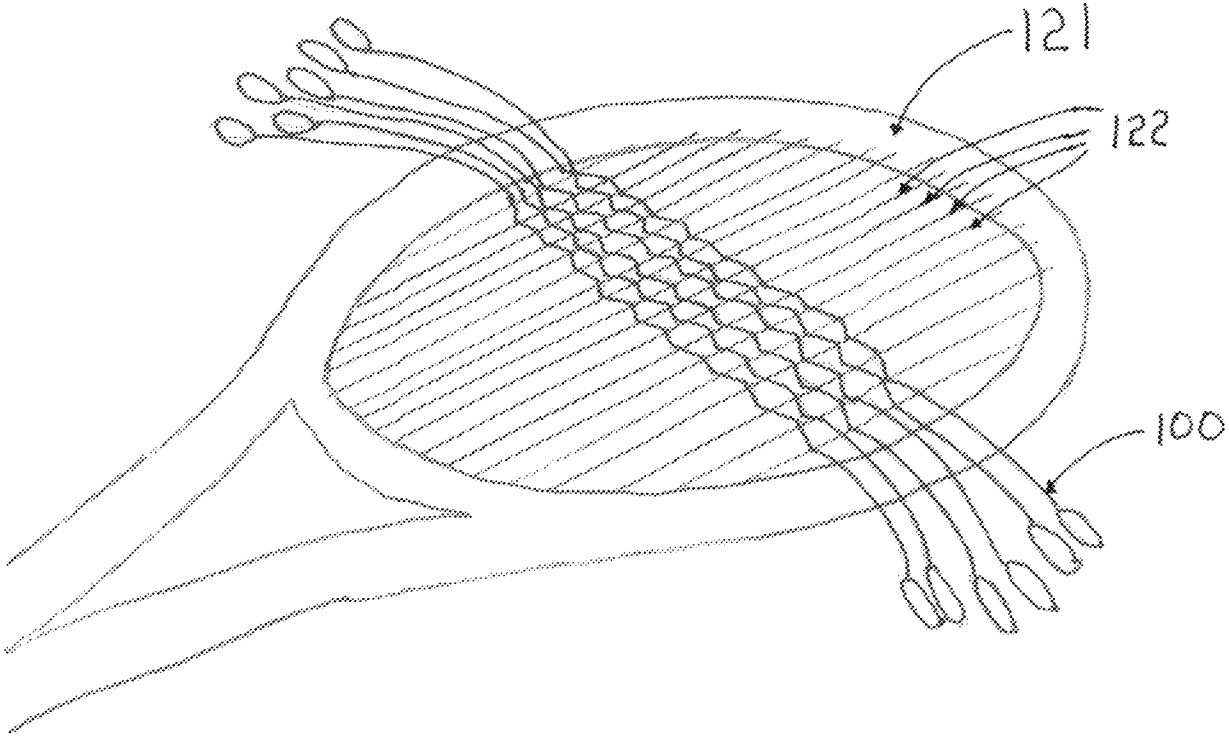
FIG. 4C is a top view of a racket with the string guide holder removed and the cross-string guides in place on the main strings in accordance with an illustrative embodiment of the invention.

FIG. 4C is an oblique view of a racket frame 121 illustrating the placement of string guides 100 woven through the racket main strings 122 after removal of the string guide holder.

Figure 4D:
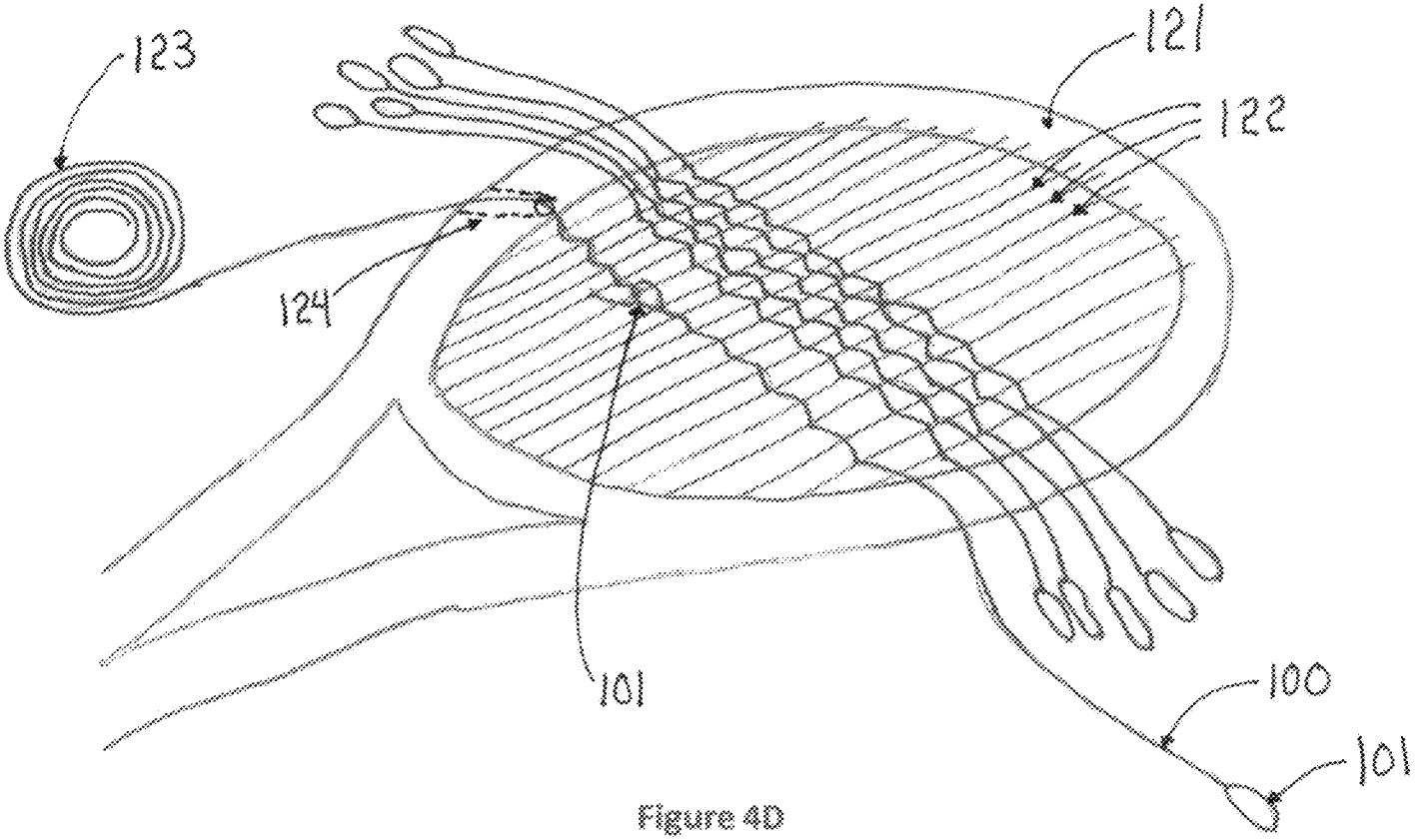
FIG. 4D is a top view of a racket with the string guide holder removed and the cross-string guides in place on the main strings and one of the cross-strings partially woven through the main strings by one of the string guides in accordance with an illustrative embodiment of the invention.

FIG. 4D is an oblique view of a racket frame 121 illustrating the placement of string guides 100 woven through the racket main strings 122 after removal of the string guide holder. This illustration also shows a roll of racket string 123 with one end of the racket string being pulled through the racket frame grommet hole 124 and then about 6 inches is fed through the cross-string guides loop with hollow core dacron loop connection 101. The person stringing the racket then pulls the string guide loop 101 on the other end of the string guide 100 causing the racket string to pull through the racket main strings 122 in the proper weave pattern.

Figure 5C:
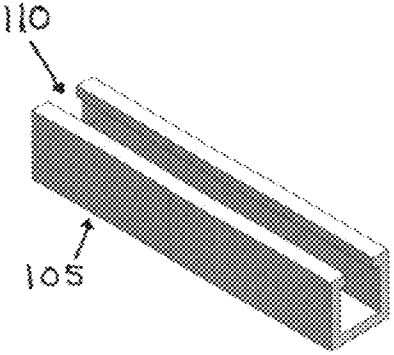
FIG. 5C is an isometric view of a hollow longitudinal guide illustrating a rectangular shape.
Figure 5B:
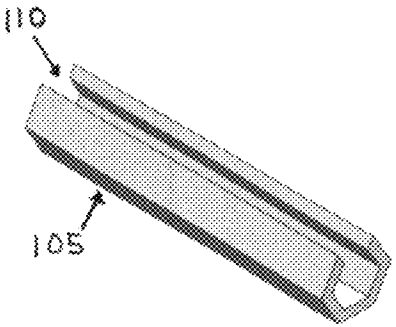
FIG. 5B is an isometric view of a hollow longitudinal guide illustrating a hexagonal shape.
Figure 5E:
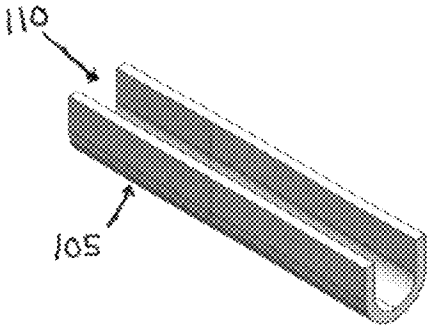
FIG. 5E is an isometric view of a hollow longitudinal guide illustrating a "U" shape.
Figure 5A:
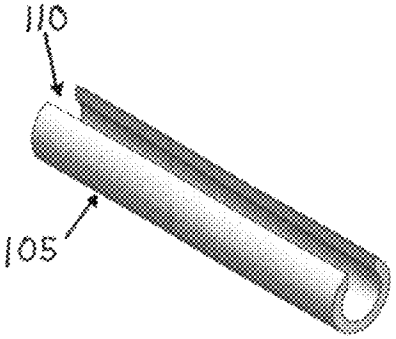
FIG. 5A is an isometric view of a hollow longitudinal guide illustrating a circular shape.

FIG. 5A is an isometric view of a hollow longitudinal guide 105 illustrating a circular shape and a hollow longitudinal guide opening 110.

FIG. 5B is an isometric view of a hollow longitudinal guide 105 illustrating a hexagonal shape and a hollow longitudinal guide opening 110.

FIG. 5C is an isometric view of a hollow longitudinal guide 105 illustrating a rectangular shape and a hollow longitudinal guide opening 110.

Figure 5D:
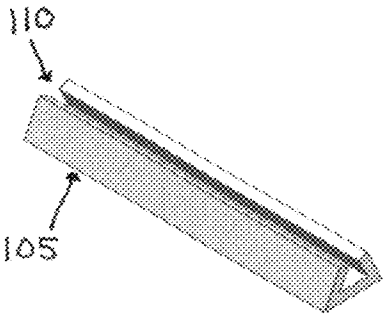
FIG. 5D is an isometric view of a hollow longitudinal guide illustrating a triangular shape.

FIG. 5D is an isometric view of a hollow longitudinal guide 105 illustrating a triangular shape and a hollow longitudinal guide opening 110.

FIG. 5E is an isometric view of a hollow longitudinal guide 105 illustrating a "U" shape and a hollow longitudinal guide opening 110.

Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention.

What is claimed is:

1. A collection of parallel hollow longitudinal guides, each having a longitudinal opening on one side, with cross-string guides woven around the hollow longitudinal guides to facilitate the placement and pulling of cross-strings through the main strings during the racket stringing process wherein one or both ends of each cross-string guide contains a loop which is used for connecting the racket string to the cross-string guide while pulling the racket string through the main strings.

2. The collection of longitudinal and cross-string guides of claim 1, wherein the hollow longitudinal guides are connected together at one end.

3. The collection of longitudinal and cross-string guides of claim 1, wherein the hollow longitudinal guides are connected together at both ends.

4. The collection of longitudinal and cross-string guides of claim 1, wherein the hollow longitudinal guides are connected together in the middle.

5. The collection of longitudinal and cross-string guides of claim 1, wherein the hollow longitudinal guides are connected together and have an attached handle used for positioning the collection of hollow longitudinal guides.

6. A collection of parallel hollow longitudinal guides, each having a longitudinal opening on one side, with cross-string guides woven around the hollow longitudinal guides to facilitate the placement and pulling of cross-strings through the main strings during the racket stringing process wherein one or both ends of each cross-string guide contain an attached fixture which is used for connecting the racket string to the cross-string guide while pulling the racket string through the main strings.

* * * * *